US008118453B2

(12) United States Patent
Holten

(10) Patent No.: US 8,118,453 B2
(45) Date of Patent: Feb. 21, 2012

(54) LUMINAIRE AND LAMELLAE LOUVER THEREFOR

(75) Inventor: Peter Holten, Winterswijk (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 321 days.

(21) Appl. No.: 11/718,725

(22) PCT Filed: Nov. 7, 2005

(86) PCT No.: PCT/IB2005/053648

§ 371 (c)(1),
(2), (4) Date: May 7, 2007

(87) PCT Pub. No.: WO2006/051473

PCT Pub. Date: May 18, 2006

(65) Prior Publication Data

US 2008/0130287 A1 Jun. 5, 2008

(30) Foreign Application Priority Data

Nov. 12, 2004 (EP) ..... 04105738

(51) Int. Cl.
*F21V 11/02* (2006.01)
*F21V 7/00* (2006.01)

(52) U.S. Cl. ..... 362/290; 362/279; 362/291; 362/292; 362/342; 362/354

(58) Field of Classification Search ..... 362/279, 362/290–292, 325, 342, 354
See application file for complete search history.

(56) References Cited

U.S. PATENT DOCUMENTS 6,220,729 B1 * 4/2001 Holten ..... 362/291
6,626,560 B1 * 9/2003 Caferro et al. ..... 362/290

FOREIGN PATENT DOCUMENTS

WO WO-03/064918 A2 * 8/2003

* cited by examiner

*Primary Examiner* — Diane I Lee
*Assistant Examiner* — Sean Gramling

(57) ABSTRACT

The luminaire has concave side reflectors defining the width W of a light emission window. V-shaped lamellae are present between the side reflectors in the light emission window. Each outer edges of the lamellae has a central portion which is concavely curved and straight end portions which each have a length of 0.15 to 0.25 W. The lamellae louver is suitable for use in the luminaire.

14 Claims, 3 Drawing Sheets

LUMINAIRE AND LAMELLAE LOUVER THEREFOR

Figure 1:
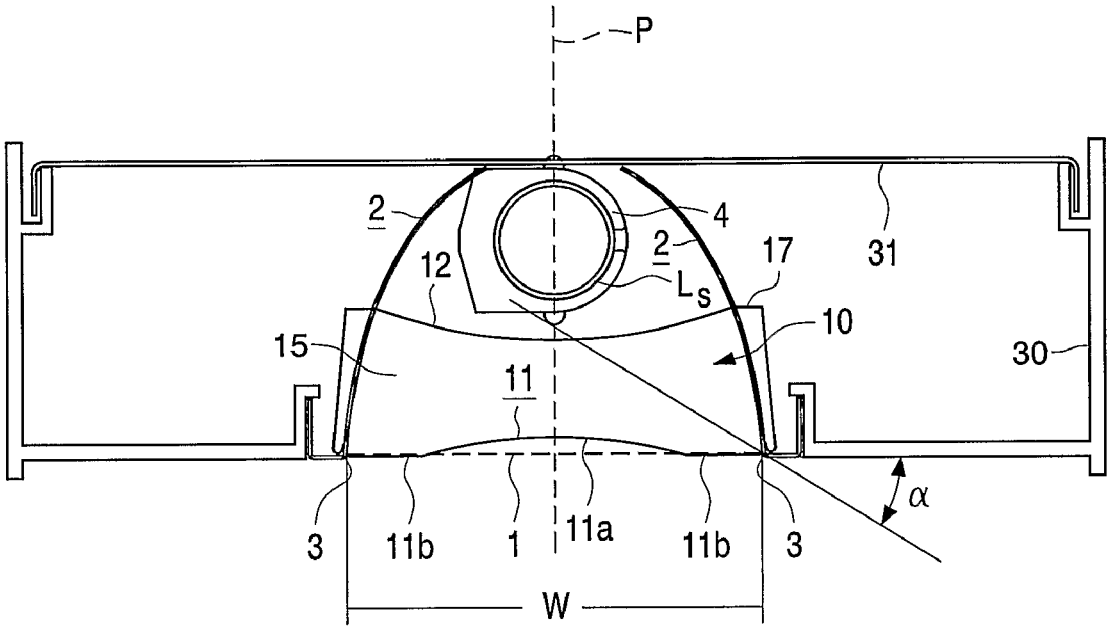

The invention relates to a luminaire provided with:

a light emission window of a width W;

elongate side reflectors, placed opposite each other, equidistant from a plane P that is perpendicular to the light emission window, which side reflectors each have an edge defining the width W of the light emission window and are concavely curved transverse to the edge, inclining towards one another in a direction away from the light emission window;

means for accommodating an elongate electric lamp Ls between the side reflectors, along the light emission window and in plane P; and a plurality of substantially parallel, substantially equidistant lamellae transverse to plane P and to the light emission window, which lamellae each have a V-shaped cross-section, an outer edge which is remote from said means, and an inner face remote from the light emission window, the outer edge having a central portion through plane P in which the outer edge has a concave shape and straight end portions adjacent the side reflectors.

The invention also relates to a lamellae louver comprising a plurality of substantially parallel, substantially equidistant, interconnected lamellae having a V-shaped cross-section, an outer edge, and an inner face facing away therefrom, the outer edge having a central portion in which the outer edge has a concave shape and straight end portions.

An embodiment of such a luminaire, as well as of such a louver, is described in the non-prepublished patent application EP 0401981.1 (PHNL040484).

The lamellae of said prior luminaire and louver have intermediate portions between the central portion and the end portions. They have a very small height $h_0$ in their center related to the width W and are mounted close to the accommodated lamp, remote from the light emission window.

The purpose of their shape and size is to create a proper shielding angle in which substantially no light is emitted, and nevertheless to have a low material content.

The side reflectors collect the light generated by an operating accommodated electric lamp Ls into a beam and create a shielding angle aside the luminaire within which the lamp is not visible. The lamellae have a shielding function in plane P and in planes surrounding plane P to avoid that the lamp can be seen from within an angle corresponding to said shielding angle.

The lamellae have a triangular cross-section, the base of which is inside the luminaire. The flanks of the lamellae may be flat or concave. Such lamellae are required if the luminaire is intended for use in rooms in which computer terminals are present. Light rays reflected by the lamellae are reflected at a greater angle to the light emission window, owing to the triangular cross-section, than corresponding light rays by flat lamellae. It is avoided thereby that light rays are reflected within the shielding angle in plane P and in surrounding planes and cause annoying reflections on screens of terminals.

It is another function of the lamellae to prevent that images of the lamp formed in the side reflectors can be observed within the shielding angle. In order to achieve this, lamellae generally are relatively extended and voluminous, having the effect that additional reflections occur in the luminaire which cause loss of light due to absorption at each reflection.

When a luminaire is operated mounted against a ceiling, in a false ceiling, or suspended from a ceiling, the light emission window being horizontal and facing downwards, the shielding angle $\alpha$ of e.g. 30° is the angle from the edge of a side reflector downwards. A proper luminaire creates such a shielding not only in a vertical plane Co, transverse to the edge, but also in all adjacent planes up to about plane $C_{45}$ by means of the side reflector, and up to plane $C_{90}$, which coincides with plane P, by means of the lamellae.

For use in offices where computer terminals are present, luminaires must obey the EN12464 standard, which specifies the Unified Glare Rating (UGR), the integral level of hinder, and which requires that UGR 19 is not exceeded.

It was observed that the prior luminaire with a relatively bright lamp operated therein causes glare and thus does not comply with said standard for use in offices, although a proper shielding angle in all C-planes is realized.

The same phenomenon occurs with the luminaire of EPB-0 757 772 when a relatively bright lamp is mounted therein, which luminaire has lamellae present in the light emission window and having a fully concave outer edge.

It is a disadvantage of the said prior luminaire that it causes impermissible glare in an office environment when a relatively bright lamp is operated therein.

It is a first object of the invention to provide a luminaire of the kind described in the opening paragraph with which the occurrence of glare is counteracted, also when a relatively bright lamp is operated therein.

It is another object of the invention to provide a lamellae louver of the kind described in the opening paragraph with which, when used in the light emission window of a luminaire, the occurrence of glare is counteracted, also when a relatively bright lamp is operated therein.

The first object is achieved in that the luminaire has the features of claim 1.

To counteract glare and to satisfy the said URG 19 requirement, the luminaire must have each of the features of claim 1.

The invention is based on the recognition that at an angle in the range of a to approximately $\alpha$+10° strong intensity variations occur in the region of approximately plane $C_{45}$ to approximately plane $C_{60}$ owing to the sudden increase in size of lamp details and of lamp images in the side reflector, and that these intensity variations cause glare.

If the end portions have a length smaller than 0.15, a correction of intensity variations is brought about that is insufficient for complying with the aforementioned standard. If said length is greater than 0.25, the shielding in planes in the range of approximately $C_{60}$ to approximately $C_{80}$ is too strong.

Said correction is achieved only when the lamellae are present in the light emission window.

The outer edges of the end portions are in line with one another, enclose an angle of 180°, or each have a deviation therefrom of up to 5° outwards, enclose an angle of up to 170°, or inwards, enclose an angle of up to 190°, otherwise the correction required is impeded.

The central portion has the size which follows from W and the length of the end portion, otherwise too strong a shielding in and immediately around plane $C_{90}$ is obtained.

The luminaire of the invention, however, admits of the use of a relatively small number of lamellae of relatively great height, great $h_0$, extending up to a small distance of a few mm away from the lamp to be accommodated, and of the use of a relatively large number of lamellae of small $h_0$ for achieving a same shielding in longitudinal directions.

It is an advantage of the luminaire of the invention that the material content of the lamellae is small compared with the content of the lamellae of the luminaire of the cited EPB-0 757 772, which have a fully concave outer edge. This advantage is particularly considerable when the lamellae are of high-quality mirroring material, which is rather expensive. The advantage, however, also plays a role if the lamellae are of synthetic resin such as polycarbonate (PC), polystyrene (PS), or polystyrene.acrylonitril-butadienenstyrene (PS.ABS), because expensive heat-resistant resins must be used for safety reasons. Generally, such lamellae have a mirroring coating.

Most present-day indoor luminaires for office lighting are intended for use with a low-pressure mercury fluorescent lamp and have a width W of 80 mm. However, there is a trend towards smaller luminaires which have a width in the range of two and a half to four times the diameter of the lamp to be accommodated: 40 to 64 mm. The lamp of 16 mm diameter creates a luminous flux comparable to that of a 25 mm diameter lamp, but has a higher brightness. In a small luminaire, small side reflectors must concentrate the generated light into a light beam. As a result, images of the lamp in the side reflectors are very bright and the risk of glare is much increased. The invention is therefore particularly useful for a luminaire having the feature of claim 2.

Several measures can be taken to avoid that light rays from the lamp are reflected by the inner face of a lamella to a side reflector and from there into the shielding angle. The inner face may be blackened, which causes loss of light, however, or be profiled to direct reflected light deeper into the luminaire than would otherwise occur. Alternatively, the inner face may be open adjacent the side reflectors. The area from which annoying light rays could leave is absent then, whereas the remaining inner face can reflect light to limit the loss of light.

It is advantageous, however, if the inner face has a concave curvature transverse to plane P for the said purpose. Light is reflected by the inner face deeper into the luminaire also in this case, and subsequent reflections into the shielding angle $\alpha$ are effectively counteracted. Loss of light is minimized thereby.

The lamellae have a relatively small greatest height, i.e. the dimension transverse to the light emission window, compared with the lamellae of the cited EPB-0 757 772, owing to the straight end portions. This renders it possible for the luminaire to have the features of claim 4 and nevertheless produce an excellent light beam. A kink in the flanks parallel to the light emission window is not required to prevent the inner face from being rather broad at its ends. A narrow inner face is of interest, because the narrower the inner face, the fewer reflections will occur and the less loss of light will be caused by absorption.

It is favorable, therefore, for the luminaire to have the feature of claim 5. The width of the inner face is determined by its width in plane P.

The lamellae may have the features of claim 6. The advantage thereof is that the inner face of the lamella is at least substantially optically closed. The higher the number of lamellae in the luminaire, and the smaller the width of the inner face, the more important is a longitudinal gap in the inner face as a cause of loss of light. This loss is substantially prevented. It should be noted that the outer edge is thinnest if the flanks meet there in an abutting manner only. A fold in the region of the end portions to connect both flanks is thicker than two abutting flanks. For a given curvature in plane P, the thickness at the outer edge determines the width of the inner face in plane P. A small thickness at the outer edge and a small width of the inner face are of importance, because any obstruction to the passage of light is small then.

The lamellae may be made of metal, e.g. aluminum, and be specularly or semi-specularly reflecting.

The lamellae may be inseparably connected to the side reflectors. In an embodiment, however, the luminaire has the feature of claim 7. A louver of plastic is easy to manufacture and has the advantage that much assembling work is avoided that would be necessary if the lamellae were separate bodies. The louver may e.g. have a click connection to the side reflectors. Alternatively, the louver may be connected to end faces of the luminaire.

The second object of the invention is achieved by a lamellae louver having the features of claim 8.

What has been explained above with respect to the luminaire according to the invention applies equally to the lamellae louver.

The side reflectors may be united to form a reflector body which is also present opposite the light emission window. The luminaire may also or alternatively be present in a housing. An e.g. lacquer-coated wall thereof opposite the light emission window may constitute a reflector. The luminaire may, however, have a second window opposite the light emission window in order also to provide indirect lighting.

Mounted against, in, or below a ceiling, the luminaire may be used for illuminating e.g. offices and shops. A housing of the luminaire may contain two or more of the luminaire units described.

An embodiment of the luminaire and of the lamellae louver according to the invention is shown in and explained with reference to the drawings.

Figure 2:
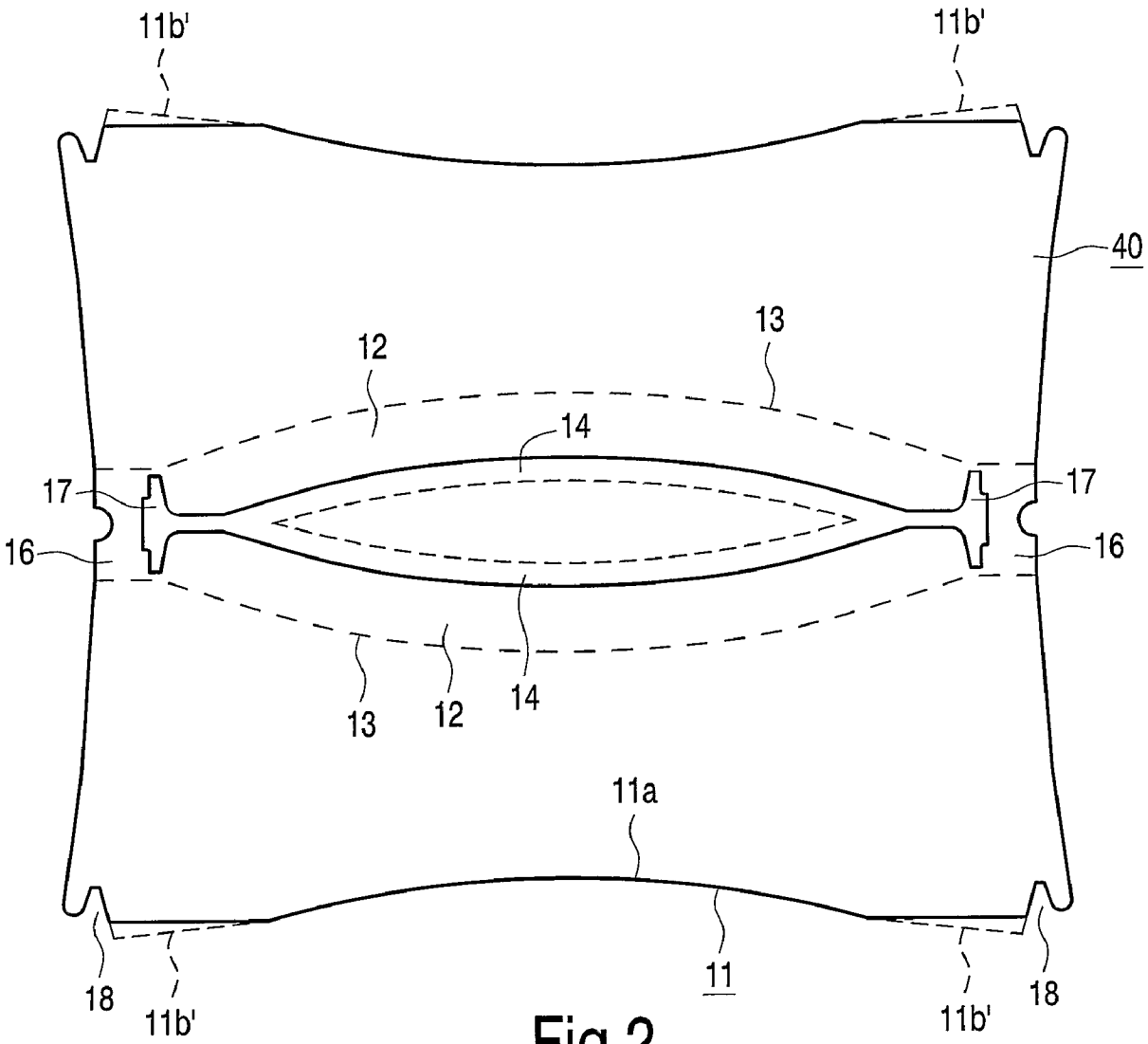
Figure 3:
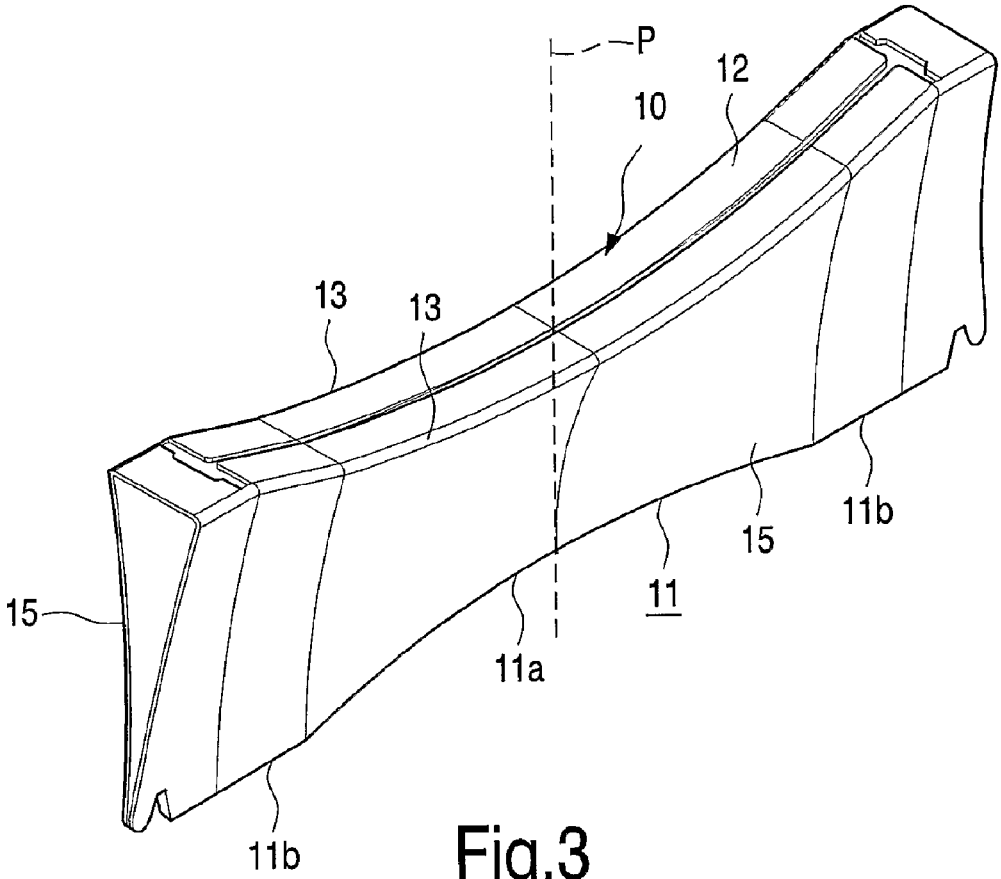
Figure 4:
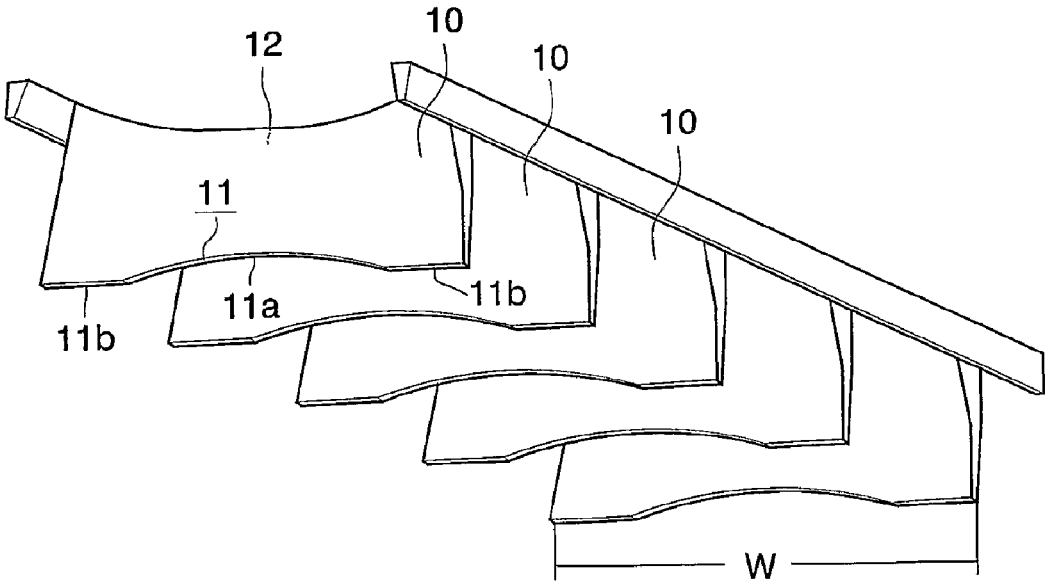

In the drawings:

FIG. 1 represents a cross-section through an embodiment;

FIG. 2 a shaped piece of metal plating from which a lamella can be folded;

FIG. 3 a perspective view of the lamella;

FIG. 4 a perspective view of an embodiment the lamella louver.

In FIG. 1, the luminaire has a light emission window 1 of a width W. Elongate side reflectors 2 are placed opposite each other, equidistant from a plane P that is perpendicular to the light emission window 1, which side reflectors 2 each have an edge 3 defining the width W of the light emission window 2. They are concavely curved transverse to the edge 3, inclining towards one another in a direction away from the light emission window 1. Means 4 are present for accommodating an elongate electric lamp Ls between the side reflectors 2, along the light emission window 1, and in plane P. In the FIG. the means 4 are a pair of lampholders, one of which is visible, for accommodating a low-pressure mercury fluorescent lamp. A plurality of substantially parallel, substantially equidistant lamellae 10 are present, transverse to plane P and to the light emission window 1. The lamellae 10 each have a V-shaped cross-section, an outer edge 11 which is remote from the means 4, and an inner face 12 remote from the light emission window 1. The outer edge 11 has a central portion 11*a* through plane P in which the outer edge 11 has a concave shape, and straight end portions 11*b* adjacent the side reflectors 2.

The lamellae 10 have a length W and are present in the light emission window 1.

The central portion 11*a* of the outer edge 11 directly merges into the straight end portions 11*b*. The straight end portions 11*b* each have a length in the range of 0.15 to 0.25 W and are at an angle in the range of 170° to 190° to one another. In the FIG. the straight end portions 11*b* each have a length of 0.18 W. They are at an angle of 180°.

W is in the range of 40 to 64 mm. In the FIG. W is 55 mm.

FIG. 1 shows the luminaire in a housing 30, the top wall 31 of which is coated white to act as a reflector.

The inner face 12 of the lamellae 10 has a concave curvature transverse to plane P to reflect light rays deeper into the luminaire than would otherwise occur. It is achieved thereby that the side reflectors reflect these rays more steeply and outside the shielding angle α.

The luminaire of FIG. 1 has lamellae 10, each of which has flanks 15 which extend from the outer edge 11 up to the inner face 12 and are concavely curved, the curvature diminishing from relatively strong in plane P to relatively weak adjacent the side reflectors 2. This is best seen in FIG. 2. The lines drawn in the flanks 15 show the curvature of the flanks 15.

It is also apparent from FIG. 2 that the inner face 12 has a substantially constant width over its length.

The lamellae 10 are each made from a respective piece 40 of sheet metal, as shown in FIG. 3, and have folding lines 13 bounding the inner face 12 and the flanks 15, which lines extend between the inner face 12 and the outer edge 11. The flanks 15 only abut one another at the outer edge 11, as is apparent from FIG. 2. The lamella 10 of FIG. 2 is one unitary member because of the presence of bridges 16, see FIG. 3, which in FIG. 1 are outside the side reflectors 2, because the side reflectors 2 snap into holes 17 and recesses 18. The shaped piece shown in FIG. 2 results in the lamella 10 of FIG. 3, having a longitudinal gap in the inner face 12. When a shaped piece of FIG. 2 having an inner contour as represented by dashed lines is used, however, the inner face 12 of FIG. 3 is constituted by overlapping portions 14.

FIG. 2 also shows in dashed lines an alternative in which the end portions 11*b*' enclose an angle of 170° with one another.

The luminaire complies with the requirements of the cited standard also if a very bright lamp is operated therein. The luminaire causes an additional shielding of a few degrees in the region of planes $C_{45}$ to $C_{60}$, but it was found that this causes substantially no loss of light. Compared with the lamellae of the known luminaire of the cited EP patent, the present lamellae 10 have a smaller surface area and thus cause fewer reflections.

The lamellae 10 may be united to constitute a louver which is detachably connected to the side reflectors 2. This is particularly useful in the case of plastic lamellae 10.

The lamella louver of FIG. 4 has a plurality of substantially parallel, substantially equidistant, interconnected lamellae 10, which each have a V-shaped cross-section, an outer edge 11, and an inner face 12. The outer edge 11 has a central portion 11*a* in which the outer edge 11 has a concave shape and straight end portions 11*b*. The lamellae 10 have a length W, the central portion 11*a* of the outer edge 11 merging directly into the straight end portions 11*b*, which each have a length in the range of 0.15 to 0.25 W, and enclose an angle in the range of 170° to 190° with one another.

The invention claimed is:

1. A luminaire provided with:

a light emission window of a width W for emitting light out of the luminaire;

elongate side reflectors, placed opposite each other, equidistant from a plane P that is perpendicular to the light emission window, wherein the side reflectors have an edge defining the width W of the light emission window and are concavely curved transverse to the edge, inclining towards one another in a direction away from the light emission window;

a holder configured to accommodate an elongate electric lamp between the side reflectors, along the light emission window and in the plane P; and a plurality of substantially parallel, substantially equidistant lamellae transverse to the plane P and to the light emission window, wherein the lamellae have a V-shaped cross-section, an outer edge which is remote from said holder, and an inner face remote from the light emission window, the outer edge having a central portion through the plane P and straight end portions adjacent the side reflectors, wherein the central portion is between two ends and the straight end portions extend from the two ends, respectively, to the side reflectors;

wherein the lamellae have a length W equal to the width W and are present in the light emission window, wherein the central portion of the outer edge directly merges into the straight end portions, and wherein the straight end portions of the outer edge are tilted down and away from the holder relative to a line connecting the two ends of the central portion so that each of the straight end portions forms an angle greater than 180° with the line connecting the two ends of the central portion.

2. The luminaire as claimed in claim 1, wherein W is in a range of 40 to 64 mm.

3. The luminaire as claimed in claim 1, wherein the inner face has a concave curvature transverse to plane P.

4. The luminaire as claimed in claim 3, wherein each lamella has flanks which extend from the outer edge up to the inner face and are concavely curved, the curvature diminishing from relatively strong in plane P to relatively weak adjacent the side reflectors.

5. The luminaire as claimed in claim 4, wherein the inner face has a substantially constant width over its length.

6. The luminaire as claimed in claim 1, wherein the lamellae are each made from a respective piece of sheet metal and have folding lines bounding the inner face and flanks which extend between the inner face and the outer edge and merely abut one another at the outer edge, the inner face being constituted by overlapping portions.

7. The luminaire as claimed in claim 1, wherein the lamellae are united to constitute a louver which is detachably connected to the side reflectors.

8. The luminaire of claim 1, wherein the angle between the straight end portions and the line connecting the two ends of the central portion and the straight end portions is greater than 180° and less than 190°.

9. The luminaire of claim 1, wherein the angle between the straight end portions and the line connecting the two ends of the central portion and the straight end portions is approximately 190°.

10. The luminaire of claim 1, wherein the straight end portions have a length from 0.15 W to 0.25 W.

11. A lamellae louver comprising a plurality of substantially parallel, substantially equidistant, interconnected lamellae each having a V-shaped cross-section, an outer edge, and an inner face facing away therefrom, the outer edge having a central portion and straight end portions, wherein the lamellae have a length W, wherein the central portion of the outer edge directly merges into the straight end portions, wherein the central portion is between two ends and the straight end portions extend from the two ends, respectively, away from the central portion, and wherein the straight end portions are tilted down and away from the inner face relative to a line connecting ends of the straight end portions at sides of the central portion so that each of the straight end portions forms an angle greater than 180° with the line connecting the two ends of the central portion.

12. The lamellae louver of claim 11, wherein the straight end portions have a length from 0.15 W to 0.25 W.

13. The lamellae louver of claim 11, wherein the angle between the straight end portions and the line connecting the two ends of the central portion is greater than 180° and less than 190°.

14. The lamellae louver of claim 11, wherein the angle between the straight end portions and the line connecting the two ends of the central portion is approximately 190°.

* * * * *